US010808731B2

(12) United States Patent
Hsu

(10) Patent No.: US 10,808,731 B2
(45) Date of Patent: Oct. 20, 2020

(54) MULTIFUNCTIONAL AIR EXTRACTION BOOSTING PUMP

(71) Applicant: Heng-Yi Hsu, Tainan (TW)

(72) Inventor: Heng-Yi Hsu, Tainan (TW)

( * ) Notice: Subject to any disclaimer, the term of this patent is extended or adjusted under 35 U.S.C. 154(b) by 241 days.

(21) Appl. No.: 16/120,486

(22) Filed: Sep. 4, 2018

(65) Prior Publication Data

US 2020/0072248 A1 Mar. 5, 2020

(51) Int. Cl.

| | |
|---|---|
| ***F04F 5/52*** | (2006.01) |
| ***F04F 5/24*** | (2006.01) |
| ***F04F 3/00*** | (2006.01) |
| ***F04F 5/14*** | (2006.01) |
| ***F04F 5/20*** | (2006.01) |
| ***F04F 1/02*** | (2006.01) |
| ***F04F 5/16*** | (2006.01) |

(52) U.S. Cl.

CPC ..... *F04F 5/52* (2013.01); *F04F 1/02* (2013.01); *F04F 3/00* (2013.01); *F04F 5/14* (2013.01); *F04F 5/16* (2013.01); *F04F 5/20* (2013.01); *F04F 5/24* (2013.01)

(58) Field of Classification Search

CPC ..... F04F 1/02; F04F 3/00; F04F 5/14; F04F 5/16; F04F 5/20; F04F 5/52; F16K 31/60; F16K 31/602; F16K 35/027

See application file for complete search history.

(56) References Cited

U.S. PATENT DOCUMENTS

| | | | | |
|---|---|---|---|---|
| 5,007,803 | A * | 4/1991 | DiVito | F04F 1/02 417/137 |
| 10,139,010 | B2 * | 11/2018 | Tseng | F16K 31/602 |
| 2016/0258472 | A1 * | 9/2016 | Perlman | F16B 47/00 |
| 2018/0056310 | A1 * | 3/2018 | Dodd | B05B 1/267 |

FOREIGN PATENT DOCUMENTS

JP 2005171925 A * 6/2005

* cited by examiner

*Primary Examiner* — Dominick L Plakkoottam

(74) *Attorney, Agent, or Firm* — Alan D. Kamrath; Karin L. Williams; Mayer & Williams PC

(57) ABSTRACT

A multifunctional air extraction boosting pump includes an upper cover, two positioning rings mounted in the upper cover, a control valve mounted in the upper cover, an air inlet pipe connected with the upper cover, and a container connected with the upper cover. One of the positioning rings is initially mounted in the upper cover. Then, the control valve is mounted in the upper cover. Then, the other one of the positioning rings is mounted in the upper cover. Then, the air inlet pipe is mounted on the upper cover. Thus, the air extraction boosting pump is assembled easily and conveniently.

8 Claims, 9 Drawing Sheets

MULTIFUNCTIONAL AIR EXTRACTION BOOSTING PUMP

BACKGROUND OF THE INVENTION

1. Field of the Invention

The present invention relates to a pumping device and, more particularly, to a multifunctional air extraction boosting pump.

2. Description of the Related Art

An extraction pump is used to draw or extract a liquid (such as an oil and the like) from a mechanic device (such as a car and the like). The extraction pump is connected between the mechanic device and a container. The extraction pump comprises multiple conduits to allow circulation of the air. Thus, when the air flows through the conduits, the liquid in the mechanic device is drawn into or drained outward from the container by the Venturi effect. The conventional extraction pump further comprises many parts, including valves, washers and the like. However, the conventional extraction pump has a complicated construction so that the parts of the conventional extraction pump are not assembled easily and conveniently, thereby increasing the cost of production.

BRIEF SUMMARY OF THE INVENTION

The primary objective of the present invention is to provide a multifunctional air extraction boosting pump that performs air extracting and boosting functions.

In accordance with the present invention, there is provided an air extraction boosting pump comprising an upper cover, two positioning rings mounted in the upper cover, a control valve mounted in the upper cover, an air inlet pipe connected with the upper cover, and a container connected with the upper cover. The upper cover includes a cover body which has a connecting portion and an operation portion connected with each other. The operation portion of the upper cover is serially provided with a first groove, a second groove connected to the first groove, a third groove connected to the second groove, a fourth groove connected to the third groove and an air outlet channel connected to the fourth groove. The fourth groove and the air outlet channel of the upper cover have a stepped connection, with the fourth groove forming a stop face. The third groove of the upper cover has a bottom provided with a boosting channel connected to the connecting portion. The air outlet channel of the upper cover has a bottom provided with an air extracting channel connected to the connecting portion. The two positioning rings are respectively mounted in the second groove and the fourth groove of the upper cover. A first one of the two positioning rings is mounted in the second groove of the upper cover. A second one of the two positioning rings is mounted in the fourth groove of the upper cover and abuts the stop face. Each of the two positioning rings includes a ring body which is provided with a first arcuate face and a through hole. The through hole is connected to the first arcuate face. The first arcuate faces of the two positioning rings face each other. The control valve is mounted in the third groove of the upper cover and includes a valve body which is provided with an enlarged portion protruding outward. The enlarged portion of the control valve has a second arcuate face and has an interior provided with a valve chamber which forms a plurality of openings. The second arcuate face of the control valve presses the first arcuate face of each of the two positioning rings. The air inlet pipe is connected with the first groove of the upper cover and includes a pipe body which is provided with an air inlet channel. The air inlet pipe has a first end extending into the first groove of the upper cover and pressing the first one of the two positioning rings and a second end protruding from the first groove of the upper cover. The container is combined with the connecting portion of the upper cover.

According to the primary advantage of the present invention, the two positioning rings, the control valve and the air inlet pipe are assembled easily, conveniently and quickly by a special design so that the cost of production is decreased.

According to another advantage of the present invention, the two positioning rings, the control valve and the air inlet pipe are disassembled easily and quickly, thereby facilitating repair and maintenance of the air extraction boosting pump.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
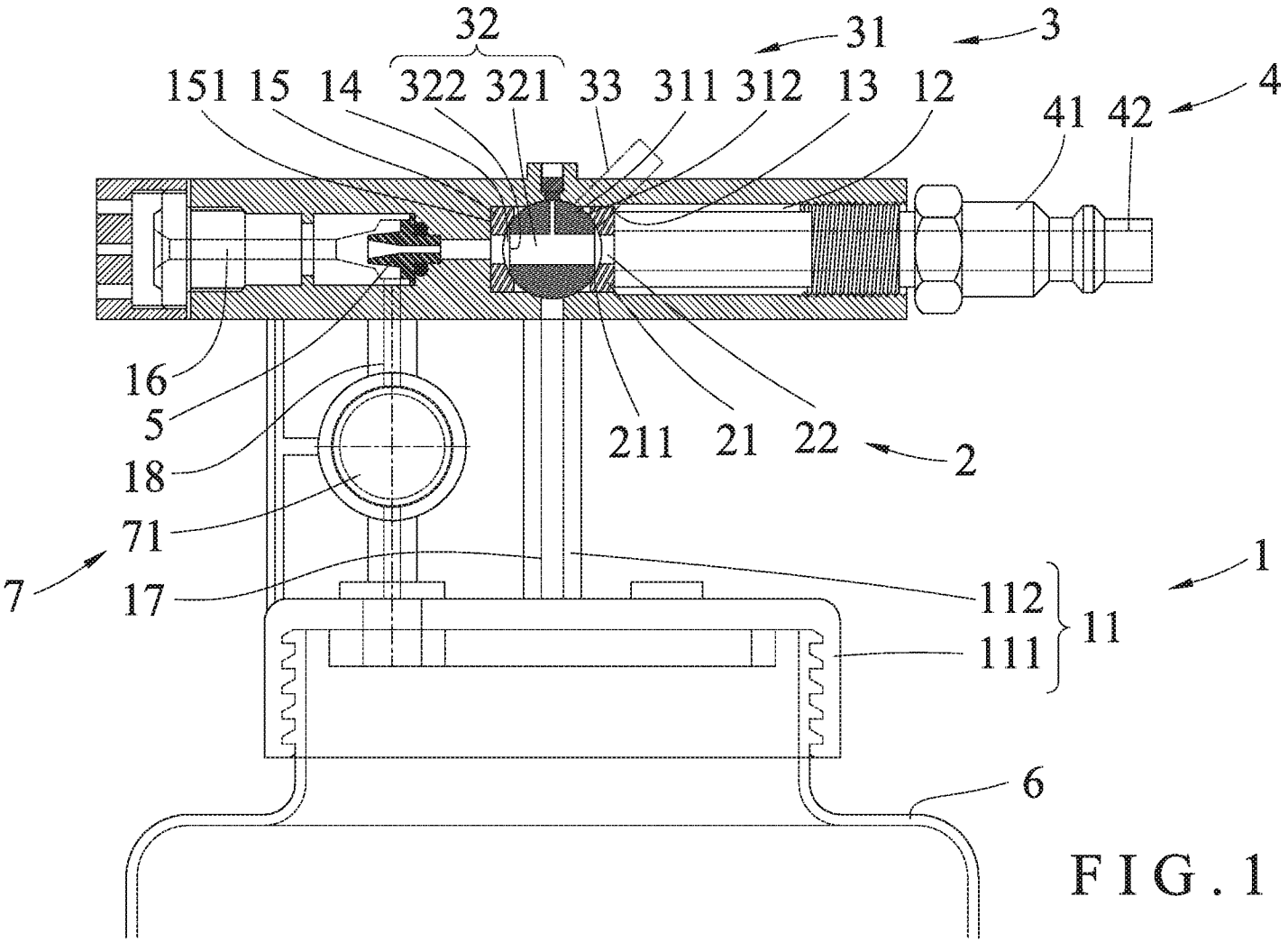
FIG. 1 is a side cross-sectional view of an air extraction boosting pump in accordance with the preferred embodiment of the present invention.
Figure 2:
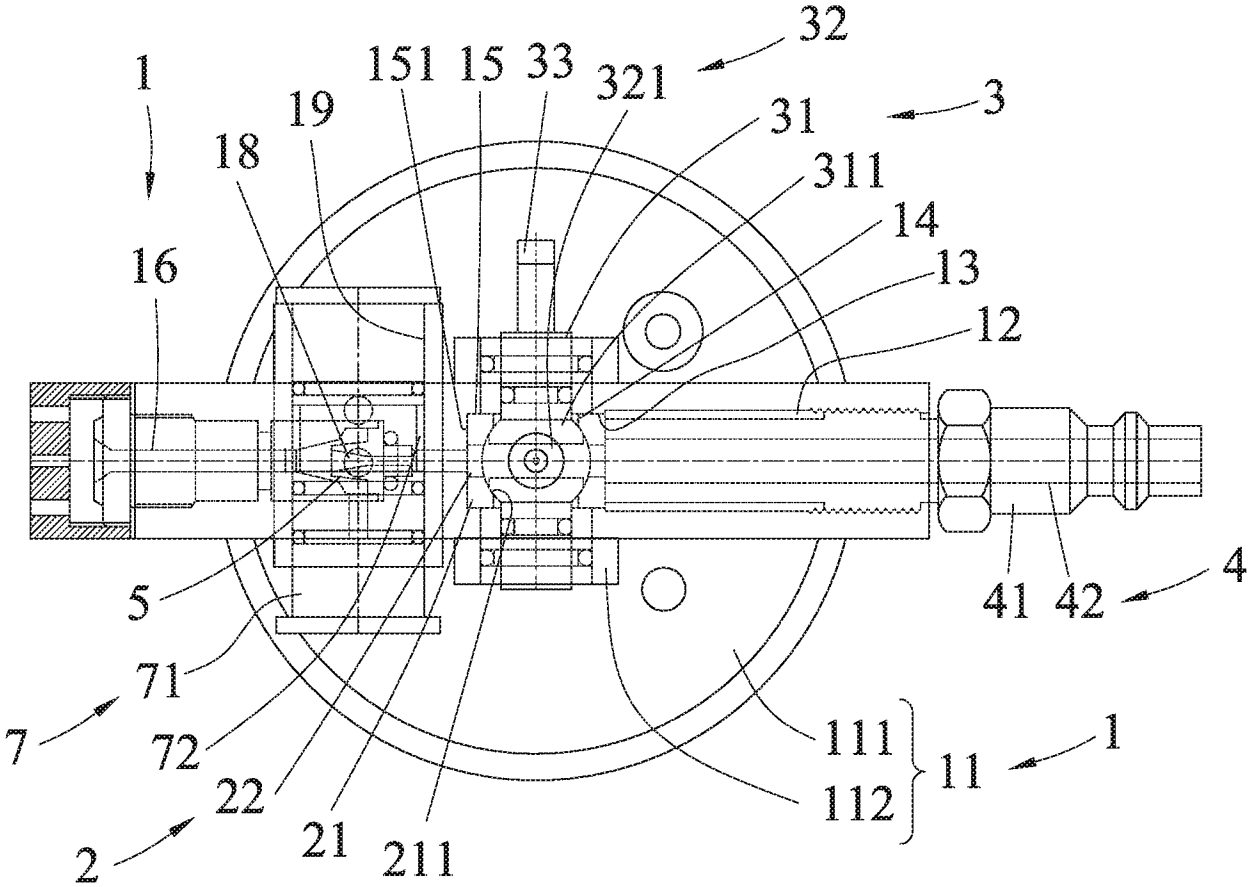
FIG. 2 is a partially top view of the air extraction boosting pump in accordance with the preferred embodiment of the present invention.
Figure 3:
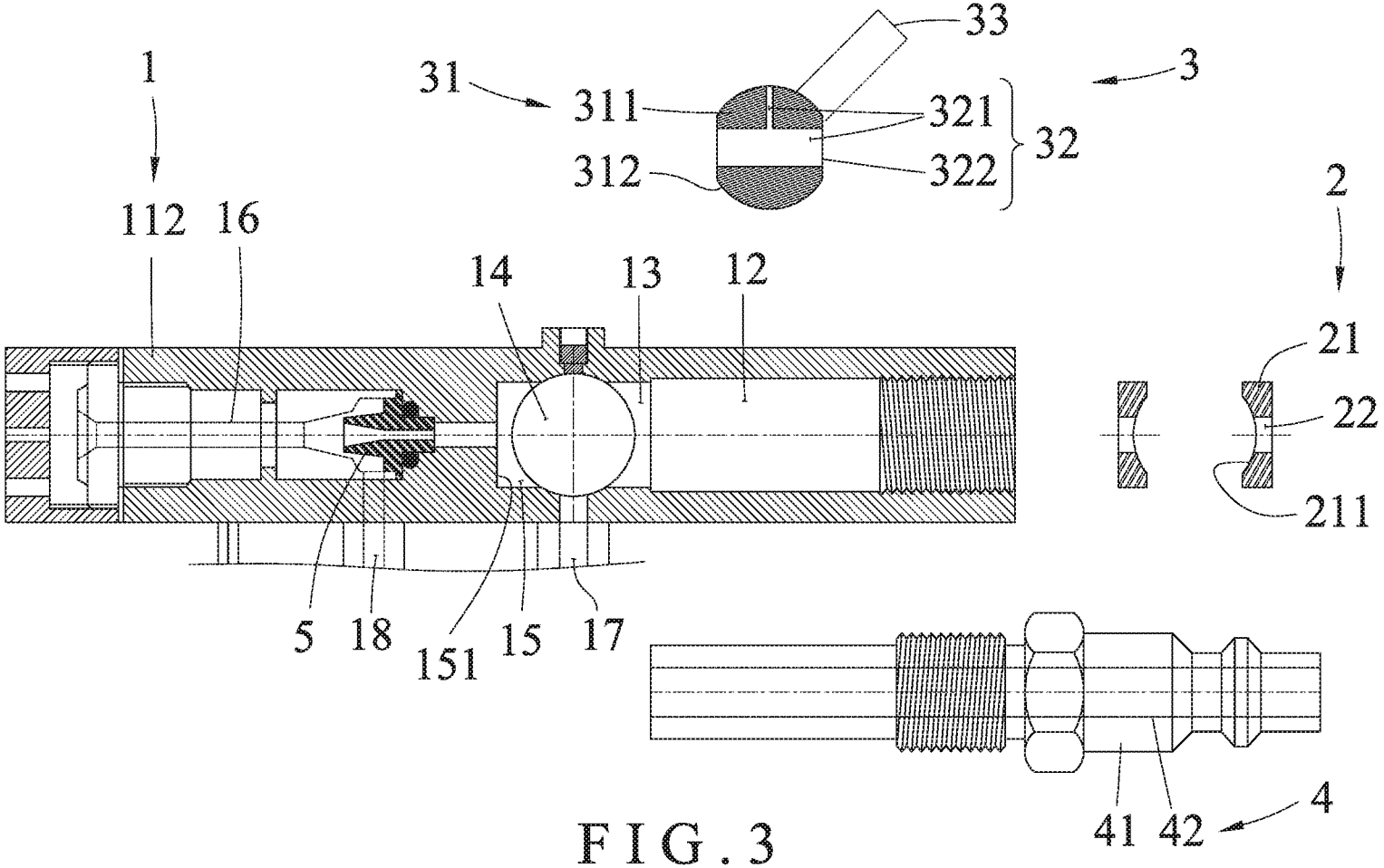
FIG. 3 is a partially exploded enlarged cross-sectional view of the air extraction boosting pump of the air extraction boosting pump as shown in FIG. 1.

Referring to the drawings and initially to FIGS. 1-3, a multifunctional air extraction boosting pump in accordance with the preferred embodiment of the present invention comprises an upper cover 1, two positioning rings 2 mounted in the upper cover 1, a control valve 3 mounted in the upper cover 1, an air inlet pipe 4 connected with the upper cover 1, and a container 6 connected with the upper cover 1.

The upper cover 1 includes a cover body 11 which has a connecting portion 111 and an operation portion 112 connected with each other. The operation portion 112 of the upper cover 1 is serially provided with a first groove 12, a second groove 13 connected to the first groove 12, a third groove 14 connected to the second groove 13, a fourth groove 15 connected to the third groove 14 and an air outlet channel 16 connected to the fourth groove 15. The first groove 12 is located at the right end of the upper cover 1, and the air outlet channel 16 is located at the left end of the upper cover 1. The fourth groove 15 and the air outlet channel 16 of the upper cover 1 have a stepped connection, with the fourth groove 15 forming a stop face 151. The third groove 14 of the upper cover 1 has a bottom provided with a boosting channel 17 connected to the connecting portion 111. The air outlet channel 16 of the upper cover 1 has a bottom provided with an air extracting channel 18 connected to the connecting portion 111.

The two positioning rings 2 are respectively mounted in the second groove 13 and the fourth groove 15 of the upper cover 1. A first one of the two positioning rings 2 is mounted in the second groove 13 of the upper cover 1. A second one of the two positioning rings 2 is mounted in the fourth groove 15 of the upper cover 1 and abuts the stop face 151. Each of the two positioning rings 2 includes a ring body 21 which is provided with a first arcuate face 211 and a through hole 22. The ring body 21 of each of the two positioning rings 2 has a width equal to that of the second groove 13 and the fourth groove 15 of the upper cover 1. The through hole 22 perforates each of the two positioning rings 2 and is connected to the first arcuate face 211. The first arcuate face 211 of each of the two positioning rings 2 has a concave shape. The first arcuate faces 211 of the two positioning rings 2 face each other.

The control valve 3 is mounted in the third groove 14 of the upper cover 1 and includes a valve body 31 which has a middle position provided with an enlarged portion 311 protruding outward. The enlarged portion 311 of the control valve 3 has a second arcuate face 312 and has an interior provided with a valve chamber 32 which forms a plurality of openings 322 located at the second arcuate face 312. Preferably, the second arcuate face 312 of the control valve 3 has a radian corresponding to the first arcuate face 211 of each of the two positioning rings 2. Thus, the second arcuate face 312 of the control valve 3 presses the first arcuate face 211 of each of the two positioning rings 2.

The air inlet pipe 4 is connected with the first groove 12 of the upper cover 1 and includes a pipe body 41 which is provided with an air inlet channel 42 which perforates the pipe body 41 and is connected to the first groove 12 of the upper cover 1. The air inlet pipe 4 has a first end extending into the first groove 12 of the upper cover 1 and pressing the first one of the two positioning rings 2 and a second end protruding from the first groove 12 of the upper cover 1.

The container 6 is combined with the connecting portion 111 of the upper cover 1.

In the preferred embodiment of the present invention, the width of the second groove 13 of the upper cover 1 is equal to that of the fourth groove 15, and the width of the first groove 12 and the third groove 14 of the upper cover 1 is greater than or equal to that of the second groove 13 and the fourth groove 15. As shown in the figures, the width of the first groove 12 and the third groove 14 of the upper cover 1 is greater than that of the second groove 13 and the fourth groove 15.

In the preferred embodiment of the present invention, the first groove 12, the third groove 14 and the air outlet channel 16 of the upper cover 1 are directly connected to an exterior of the operation portion 112, while the second groove 13 and the fourth groove 15 of the upper cover 1 are not directly connected to the exterior of the operation portion 112.

As shown in FIG. 1, the first groove 12 of the upper cover 1 is recessed in the right end of the upper cover 1, and the air outlet channel 16 of the upper cover 1 is recessed in the left end of the upper cover 1. As shown in FIG. 2, the third groove 14 of the upper cover 1 extends from one side to the other side of the upper cover 1. On the contrary, the second groove 13 of the upper cover 1 is connected to the exterior of the operation portion 112 through the first groove 12, and the fourth groove 15 of the upper cover 1 is connected to the exterior of the operation portion 112 through the air outlet channel 16. Alternatively, the second groove 13 and the fourth groove 15 of the upper cover 1 are connected to the exterior of the operation portion 112 through the third groove 14.

In the preferred embodiment of the present invention, the first groove 12 of the upper cover 1 is provided with a first thread, and the pipe body 41 of the air inlet pipe 4 is provided with a second thread screwed with the first thread of the first groove 12 of the upper cover 1.

In the preferred embodiment of the present invention, the enlarged portion 311 of the control valve 3 has a spherical shape.

In the preferred embodiment of the present invention, the valve chamber 32 of the control valve 3 includes a plurality of passages 321 which are connected with each other. In practice, the valve chamber 32 of the control valve 3 has a substantially inverted T-shaped cross-sectional configuration and includes two passages 321 which are perpendicular to each other. A first one of the passages 321 is wider and forms two openings 322, and a second one of the passages 321 is narrower and forms an opening 322, so that the valve chamber 32 of the control valve 3 contains three openings 322.

In the preferred embodiment of the present invention, an air collecting pipe 5 is secured in the air outlet channel 16 of the upper cover 1.

In the preferred embodiment of the present invention, the connecting portion 111 of the upper cover 1 is provided with a third thread, and the container 6 is provided with a fourth thread screwed with the third thread of the connecting portion 111 of the upper cover 1.

In the preferred embodiment of the present invention, the control valve 3 further includes a handle 33 connected with the valve body 31. Thus, the control valve 3 is pivoted by driving the handle 33.

Figure 4:
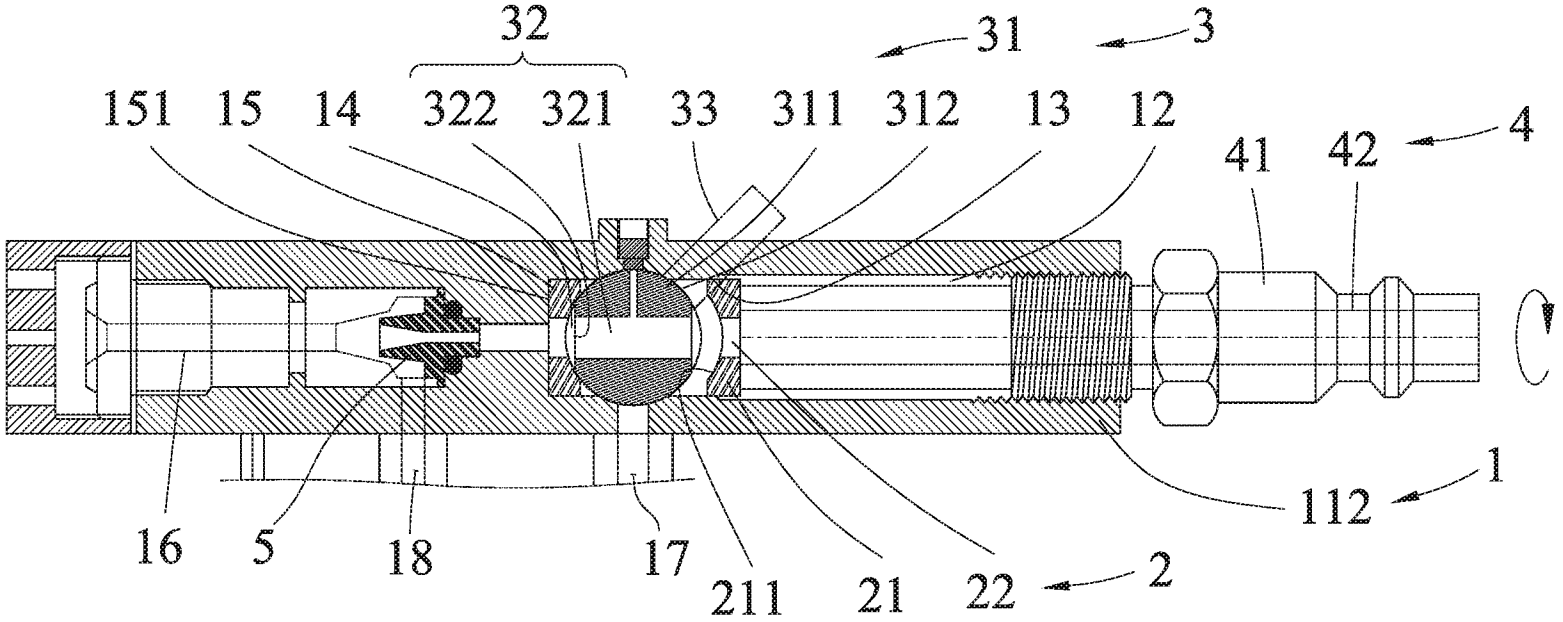
FIG. 4 is a cross-sectional assembly view of the air extraction boosting pump as shown in FIG. 3.

In assembly, referring to FIGS. 3 and 4 with reference to FIGS. 1 and 2, the fourth groove 15 of the upper cover 1 is not directly connected to the exterior of the operation portion 112. Thus, the second one of the two positioning rings 2 is inserted into the first groove 12 of the upper cover 1 by a tool, so that the second one of the two positioning rings 2 is mounted in the fourth groove 15 of the upper cover 1 and abuts the stop face 151. Then, the third groove 14 of the upper cover 1 is directly connected to the exterior of the operation portion 112, so that the control valve 3 is directly mounted in the third groove 14 of the upper cover 1, with the second arcuate face 312 of the control valve 3 pressing the first arcuate face 211 of the second one of the two positioning rings 2. The second groove 13 of the upper cover 1 is not directly connected to the exterior of the operation portion 112. Thus, the first one of the two positioning rings 2 is then inserted into the first groove 12 of the upper cover 1 by the tool, so that the first one of the two positioning rings 2 is mounted in the second groove 13 of the upper cover 1, with the first arcuate face 211 of the first one of the two positioning rings 2 pressing the second arcuate face 312 of the control valve 3. At this time, the first one of the two positioning rings 2 closely rests on the inner wall of the second groove 13 of the upper cover 1. Finally, the first end of the air inlet pipe 4 is directly screwed into the first groove 12 of the upper cover 1 and presses the first one of the two positioning rings 2, so that the air inlet pipe 4 is combined with the upper cover 1. In such a manner, the first one of the two positioning rings 2 is positioned between the stop face 151 of the upper cover 1 and the enlarged portion 311 of the control valve 3, and the first one of the two positioning rings 2 is positioned between the enlarged portion 311 of the control valve 3 and the air inlet pipe 4. In addition, the enlarged portion 311 of the control valve 3 is positioned between the two positioning rings 2 and is supported by the first arcuate face 211 of each of the two positioning rings 2, so that the control valve 3 is not displaced, but is rotatable to change the direction of each of the openings 322.

Figure 5:
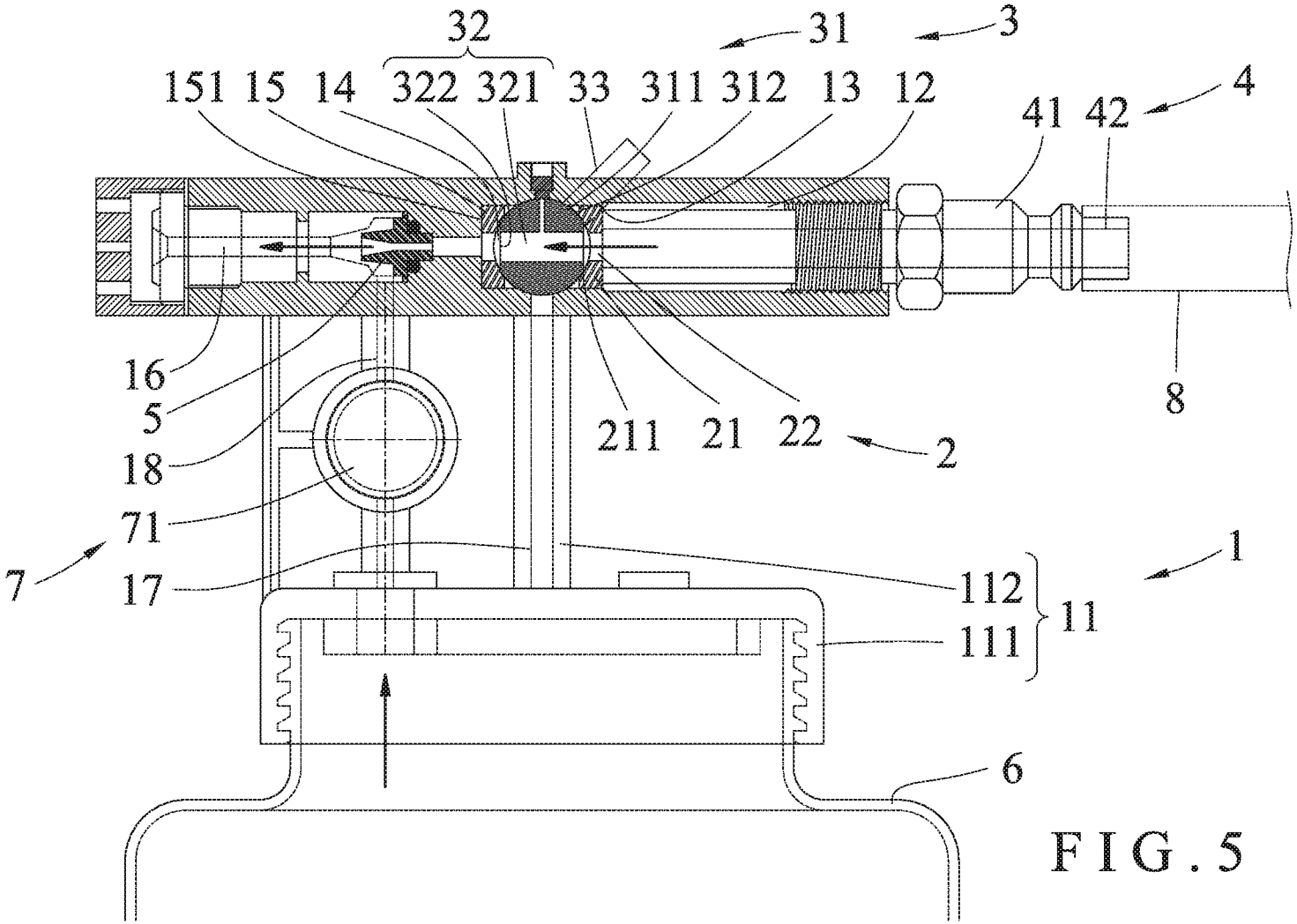
FIG. 5 is a cross-sectional view showing an air extracting process of the air extraction boosting pump in accordance with the preferred embodiment of the present invention.

In operation, referring to FIG. 5 with reference to FIGS. 1-4, the second end of the air inlet pipe 4 is connected with an air delivery pipe 8 which is connected with an air pump (not shown), and the connecting portion 111 of the upper cover 1 is connected with an oil extracting pipe (not shown). The upper cover 1 has a slot (not shown) perforating the connecting portion 111, and the oil extracting pipe is inserted into the slot of the upper cover 1. The oil extracting pipe has a first end located in the container 6 and a second end immersed into an oil. Then, the handle 33 is driven to rotate the control valve 3 so that the two openings 322 of the first one of the passages 321 align with and are respectively connected to the through holes 22 of the two positioning rings 2, and the opening 322 of the second one of the passages 321 is interrupted and closed. At this time, the boosting channel 17 of the upper cover 1 is interrupted and closed by the enlarged portion 311 of the control valve 3. Then, the air pump is started to pump the air through the air delivery pipe 8 into the air inlet channel 42 of the air inlet pipe 4, so that the air in turn passes through first groove 12 of the upper cover 1, the through hole 22 of the first one of the two positioning rings 2, the valve chamber 32 of the control valve 3, the through hole 22 of the second one of the two positioning rings 2 and the air collecting pipe 5, and finally flows outward from the air outlet channel 16 of the upper cover 1. In such a manner, when the air flows through the air collecting pipe 5 and the air outlet channel 16 of the upper cover 1, the air in the container 6 is sucked through the air extracting channel 18 into the air outlet channel 16 of the upper cover 1 by the Venturi effect, and is drained outward from the air outlet channel 16 of the upper cover 1 to decrease the pressure in the container 6. Thus, the air in the container 6 is extracted outward, and the pressure in the container 6 is decreased gradually, so that the oil is sucked through the oil extracting pipe and delivered into the container 6.

Figure 6:
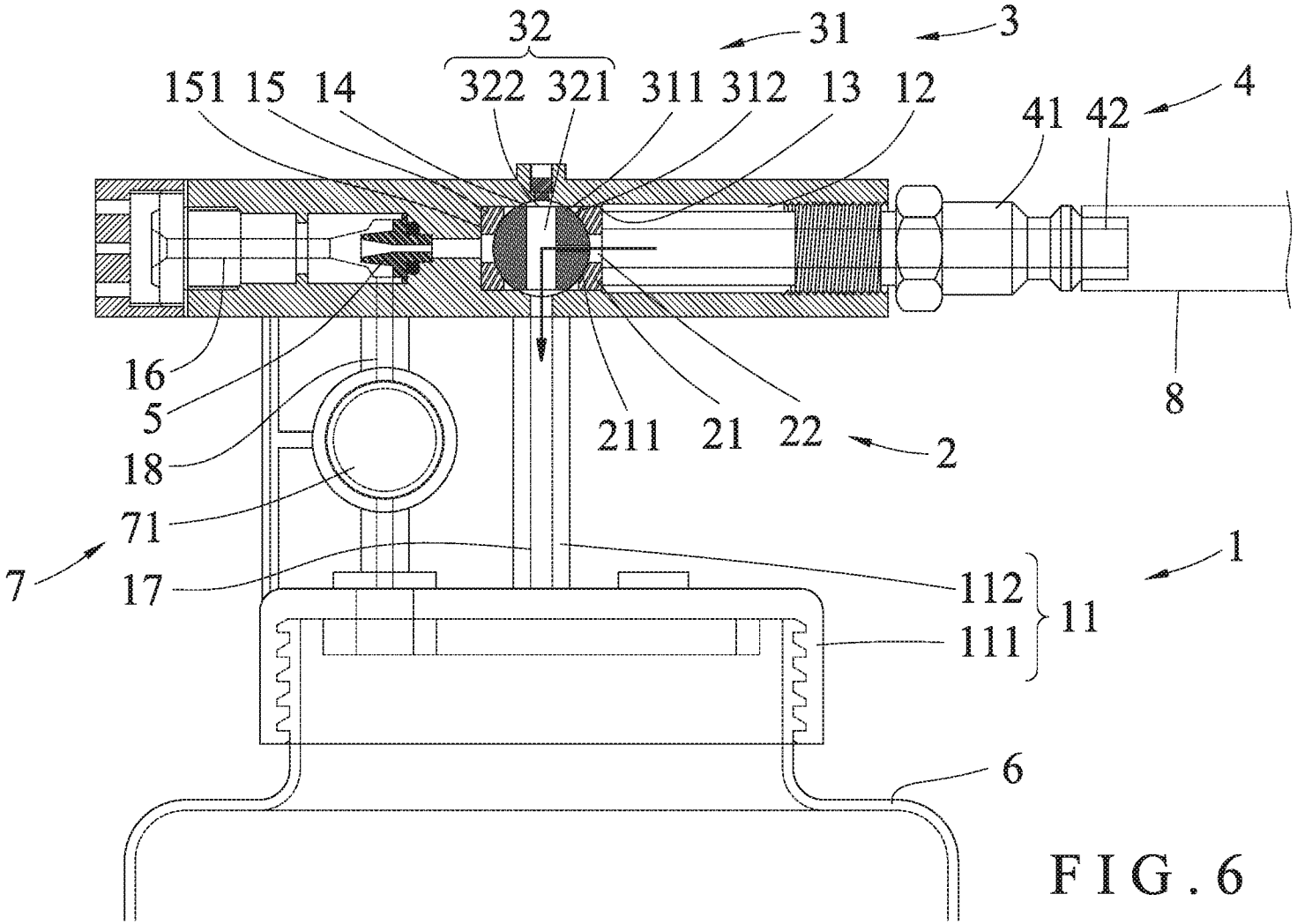
FIG. 6 is a cross-sectional view showing a boosting process of the air extraction boosting pump in accordance with the preferred embodiment of the present invention.

Alternatively, referring to FIG. 6 with reference to FIGS. 1-4, the handle 33 is driven to rotate the control valve 3 so that one of the two openings 322 of the first one of the passages 321 is connected to the boosting channel 17 of the upper cover 1, and the opening 322 of the second one of the passages 321 is connected to the through hole 22 of the first one of the two positioning rings 2. At this time, the other one of the two openings 322 of the first one of the passages 321 is interrupted and closed, and the through hole 22 of the second one of the two positioning rings 2 is interrupted and closed by the enlarged portion 311 of the control valve 3. Then, the air pump is started to pump the air through the air delivery pipe 8 into the air inlet channel 42 of the air inlet pipe 4, so that the air in turn passes through first groove 12 of the upper cover 1, the through hole 22 of the first one of the two positioning rings 2, the valve chamber 32 of the control valve 3 and the boosting channel 17 and flows into the container 6. In such a manner, when the air flows into the container 6, the pressure in the container 6 is increased gradually to pressurize the container 6, so that the oil in the container 6 is forced to flow through the oil extracting pipe and is drained outward from the container 6.

Figure 8:
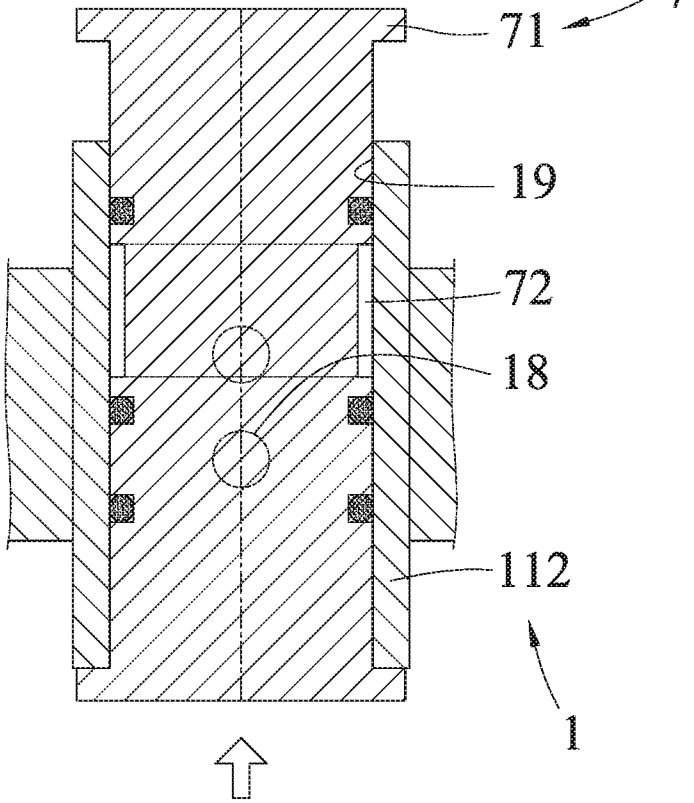
FIG. 8 is another cross-sectional operational view showing operation of the switch valve of the air extraction boosting pump in accordance with the preferred embodiment of the present invention.
Figure 7:
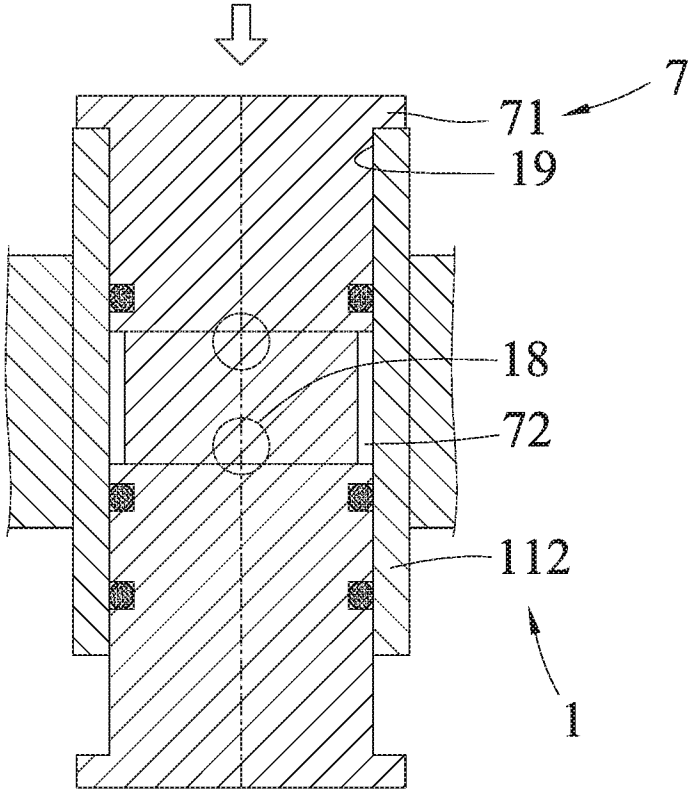
FIG. 7 is a cross-sectional operational view showing operation of a switch valve of the air extraction boosting pump in accordance with the preferred embodiment of the present invention.

Referring to FIGS. 7 and 8 with reference to FIGS. 1 and 2, the upper cover 1 is provided with a slideway 19 connected to the air extracting channel 18 of the upper cover 1, and a switch valve 7 is slidably mounted in the slideway 19 of the upper cover 1. The slideway 19 of the upper cover 1 perforates the operation portion 112. The switch valve 7 includes a valve body 71 which has an exterior provided with a guide slot 72. The valve body 71 of the switch valve 7 has a width equal to that of the slideway 19 of the upper cover 1 and has a length greater than that of the slideway 19 of the upper cover 1. Preferably, the valve body 71 of the switch valve 7 has a cylindrical shape, and the guide slot 72 of the switch valve 7 has an annular shape and surrounds the exterior of the valve body 71.

In practice, when the switch valve 7 is pressed to align and connect the guide slot 72 with the air extracting channel 18 of the upper cover 1, the air in the container 6 is allowed to flow through the air extracting channel 18 of the upper cover 1 and the guide slot 72 of the switch valve 7. On the contrary, when the switch valve 7 is pulled to misalign the guide slot 72 with the air extracting channel 18 of the upper cover 1, and to interrupt connection of the guide slot 72 of the switch valve 7 and the air extracting channel 18 of the upper cover 1, the air extracting channel 18 of the upper cover 1 closed by the switch valve 7, so that the air in the container 6 cannot flow through the air extracting channel 18 of the upper cover 1.

Thus, when the user wishes to perform the air extraction process as shown in FIG. 5, the switch valve 7 is pressed to align and connect the guide slot 72 with the air extracting channel 18 of the upper cover 1, so that the air in the container 6 is allowed to flow through the air extracting channel 18 of the upper cover 1 and the guide slot 72 of the switch valve 7 into the air outlet channel 16 of the upper cover 1. Alternatively, when the user wishes to perform the boosting process as shown in FIG. 6, the switch valve 7 is pulled to misalign the guide slot 72 with the air extracting channel 18 of the upper cover 1, and to interrupt connection of the guide slot 72 of the switch valve 7 and the air extracting channel 18 of the upper cover 1, so that the air in the container 6 cannot flow through the air extracting channel 18 of the upper cover 1, to enhance the boosting effect.

Figure 9:
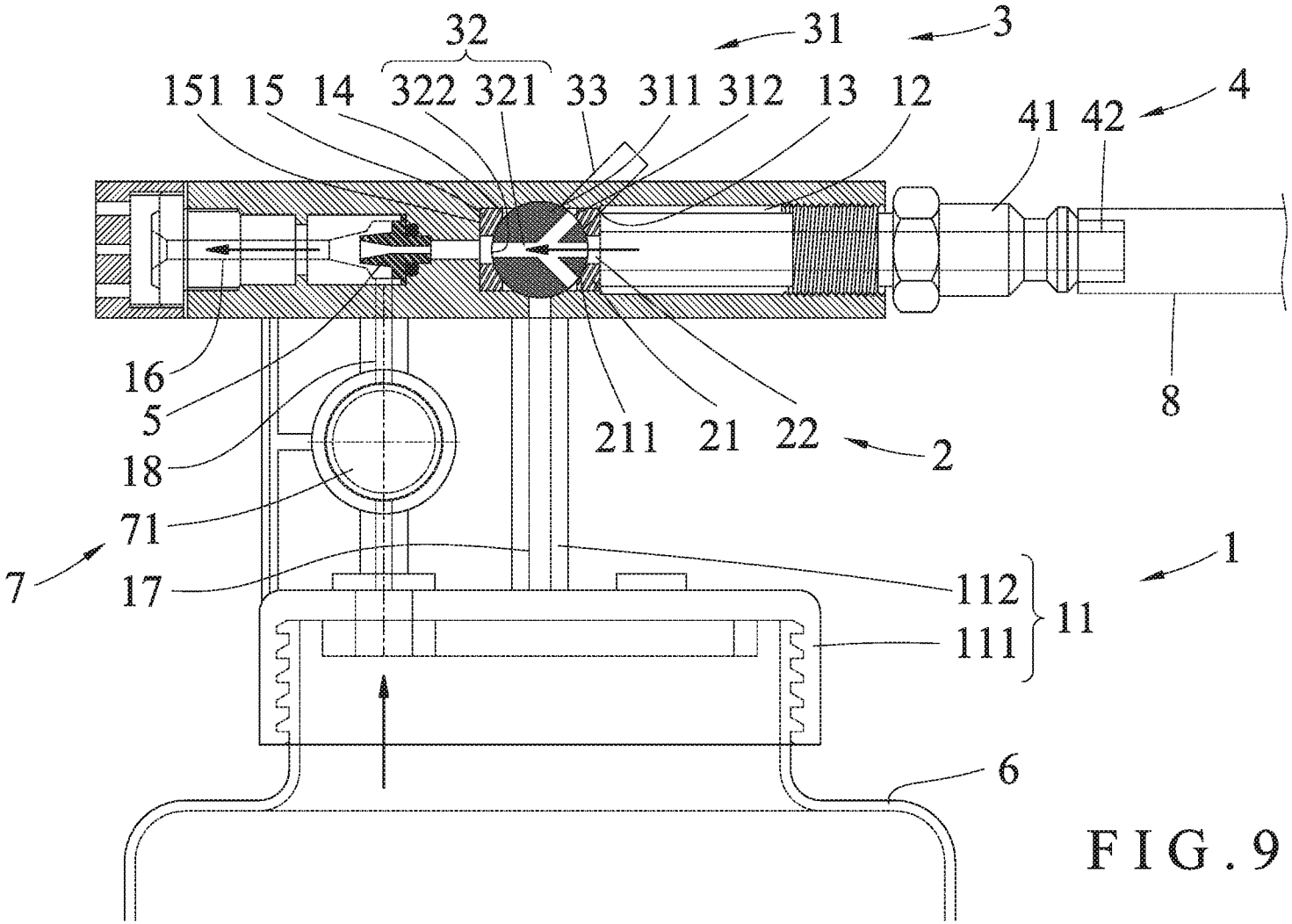
FIG. 9 is a cross-sectional view showing an air extracting process of the air extraction boosting pump in accordance with another preferred embodiment of the present invention.
Figure 10:
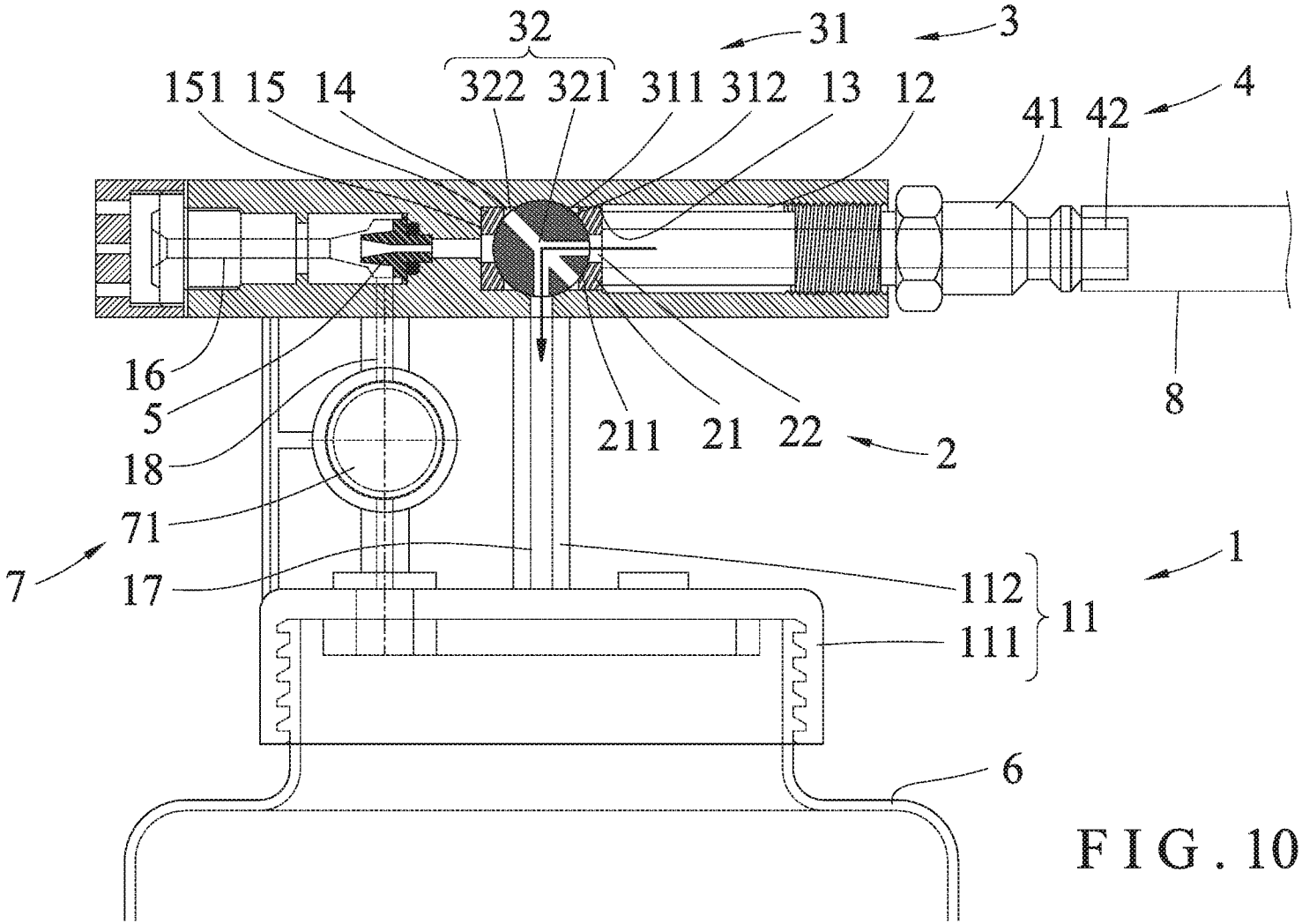
FIG. 10 is a cross-sectional view showing a boosting process of the air extraction boosting pump in accordance with another preferred embodiment of the present invention.

Referring to FIGS. 9 and 10, the valve chamber 32 of the control valve 3 has a substantially trident cross-sectional configuration and includes three passages 321 which are connected with each other and form four openings 322.

Accordingly, the two positioning rings 2, the control valve 3 and the air inlet pipe 4 are assembled easily, conveniently and quickly by a special design so that the cost of production is decreased. In addition, the two positioning rings 2, the control valve 3 and the air inlet pipe 4 are disassembled easily and quickly, thereby facilitating repair and maintenance of the air extraction boosting pump.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An air extraction boosting pump comprising:

an upper cover;

two positioning rings mounted in the upper cover;

a control valve mounted in the upper cover;

an air inlet pipe connected with the upper cover; and a container connected with the upper cover;

wherein:

the upper cover includes a cover body which has a connecting portion and an operation portion connected with each other;

the operation portion of the upper cover is serially provided with a first groove, a second groove connected to the first groove, a third groove connected to the second groove, a fourth groove connected to the third groove and an air outlet channel connected to the fourth groove;

the fourth groove and the air outlet channel of the upper cover have a stepped connection, with the fourth groove forming a stop face;

the third groove of the upper cover has a bottom provided with a boosting channel connected to the connecting portion;

the air outlet channel of the upper cover has a bottom provided with an air extracting channel connected to the connecting portion;

the two positioning rings are respectively mounted in the second groove and the fourth groove of the upper cover;

a first one of the two positioning rings is mounted in the second groove of the upper cover;

a second one of the two positioning rings is mounted in the fourth groove of the upper cover and abuts the stop face;

each of the two positioning rings includes a ring body which is provided with a first arcuate face and a through hole;

the through hole is connected to the first arcuate face;

the first arcuate faces of the two positioning rings face each other;

the control valve is mounted in the third groove of the upper cover and includes a valve body which is provided with an enlarged portion protruding outward;

the enlarged portion of the control valve has a second arcuate face and has an interior provided with a valve chamber which forms a plurality of openings;

the second arcuate face of the control valve presses the first arcuate face of each of the two positioning rings;

the air inlet pipe is connected with the first groove of the upper cover and includes a pipe body which is provided with an air inlet channel;

the air inlet pipe has a first end extending into the first groove of the upper cover and pressing the first one of the two positioning rings and a second end protruding from the first groove of the upper cover; and the container is combined with the connecting portion of the upper cover.

2. The air extraction boosting pump of claim 1, wherein a width of the second groove of the upper cover is equal to that of the fourth groove, and a width of the first groove and the third groove of the upper cover is greater than or equal to that of the second groove and the fourth groove.

3. The air extraction boosting pump of claim 1, wherein the first groove, the third groove and the air outlet channel of the upper cover are directly connected to an exterior of the operation portion, and the second groove and the fourth groove of the upper cover are not directly connected to the exterior of the operation portion.

4. The air extraction boosting pump of claim 1, wherein the first groove of the upper cover is provided with a first thread, and the pipe body of the air inlet pipe is provided with a second thread screwed with the first thread of the first groove of the upper cover.

5. The air extraction boosting pump of claim 1, wherein the enlarged portion of the control valve has a spherical shape.

6. The air extraction boosting pump of claim 1, wherein the valve chamber of the control valve includes a plurality of passages which are connected with each other.

7. The air extraction boosting pump of claim 1, wherein an air collecting pipe is secured in the air outlet channel of the upper cover.

8. The air extraction boosting pump of claim 1, wherein:

the upper cover is provided with a slideway connected to the air extracting channel of the upper cover;

a switch valve is slidably mounted in the slideway of the upper cover;

the slideway of the upper cover perforates the operation portion; and the switch valve includes a valve body which has an exterior provided with a guide slot.

* * * * *